US006379526B1

(12) United States Patent
de Nora et al.

(10) Patent No.: US 6,379,526 B1
(45) Date of Patent: Apr. 30, 2002

(54) NON-CARBON METAL-BASED ANODES FOR ALUMINIUM PRODUCTION CELLS

(75) Inventors: Vittorio de Nora, Nassau (BS); Jean-Jacques Duruz, Geneva (CH)

(73) Assignee: Moltech Invent SA (LU)

( * ) Notice: Subject to any disclaimer, the term of this patent is extended or adjusted under 35 U.S.C. 154(b) by 0 days.

(21) Appl. No.: 09/616,328

(22) Filed: Jul. 15, 2000

Related U.S. Application Data

(63) Continuation of application No. PCT/IB99/00084, filed on Jan. 19, 1999.

(51) Int. Cl.[7] ..... C25C 3/08

(52) U.S. Cl. ..... 205/384; 205/385; 204/243.1; 204/247.3; 204/290.03; 204/290.04; 204/290.06; 204/290.08; 204/290.09; 204/290.1; 204/290.12; 204/290.13; 204/290.14

(58) Field of Search ..... 204/243.1, 247.3, 204/290.03, 290.04, 290.06, 290.08, 290.09, 290.1, 290.12, 290.13, 290.14; 205/384, 385

(56) References Cited

U.S. PATENT DOCUMENTS 6,077,415 A * 6/2000 Duruz et al. ..... 204/243.1
6,113,758 A * 9/2000 de Nora et al. ..... 204/290.01

* cited by examiner

*Primary Examiner*—Bruce F. Bell
(74) *Attorney, Agent, or Firm*—Jayadeep R. Deshmukh

(57) ABSTRACT

A non-carbon metal-based anode of a cell for the electrowinning of aluminium comprising an electrically conductive metal substrate resistant to high temperature, the surface of which becomes passive and substantially inert to the electrolyte, and a coating adherent to the metal substrate making the surface of the anode electrochemically active for the oxidation of oxygen ions present at the electrolyte interface. The substrate metal may be selected from nickel, cobalt, chromium, molybdenum, tantalum and the Lanthanide series. The active constituents of the coating are for example oxides such as spinels or perovskites, oxyfluorides, phosphides or carbides, in particular ferrites. The active constituents may be coated onto the substrate from a slurry or suspension containing colloidal material and the electrochemically active material.

67 Claims, No Drawings

NON-CARBON METAL-BASED ANODES FOR ALUMINIUM PRODUCTION CELLS

This is a continuation of PCT/IB99/00084 filed on Jan. 19, 1999 and designating the United States of America, which application is co-pending.

FIELD OF THE INVENTION

This invention relates to non-carbon metal-based anodes for use in cells for the electrowinning of aluminium by the electrolysis of alumina dissolved in a molten fluoride-containing electrolyte, and to methods for their fabrication and reconditioning, as well as to electrowinning cells containing such anodes and their use to produce aluminium.

BACKGROUND ART

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as many other electrochemical processes.

The anodes are still made of carbonaceous material and must be replaced every few weeks. The operating temperature is still not less than 950° C. in order to have a sufficiently high solubility and rate of dissolution of alumina and high electrical conductivity of the bath.

The anodes have a very short life because during electrolysis the oxygen which should evolve on the anode surface combines with the carbon to form polluting $CO_2$ and small amounts of CO and fluoride-containing dangerous gases. The actual consumption of the anode is as much as 450 Kg/Ton of aluminium produced which is more than ⅓ higher than the theoretical amount of 333 Kg/Ton The frequent substitution of the anodes in the cells is still a clumsy and unpleasant operation. This cannot be avoided or greatly improved due to the size and weight of the anode and the high temperature of operation.

Several improvements were made in order to increase the lifetime of the anodes of aluminium electrowinning cells, usually by improving their resistance to chemical attacks by the cell environment and air to those parts of the anodes which remain outside the bath. However, most attempts to increase the chemical resistance of anodes were coupled with a degradation of their electrical conductivity.

U.S. Pat. No. 4,614,569 (Duruz/Derivaz/Debely/Adorian) describes non-carbon anodes for aluminium electrowinning coated with a protective coating of cerium oxyfluoride, formed in-situ in the cell or pre-applied, this coating being maintained by the addition of cerium compounds to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidized copper-nickel surface on an alloy substrate with a protective barrier layer. However, full protection of the alloy substrate was difficult to achieve.

A significant improvement was described in U.S. Pat. No. 5,510,008, and in International Application WO96/12833 (Sekhar/Liu/Duruz) involved a anode having a micropyretically produced body from a combination of nickel, aluminium, iron and copper and oxidising the surface before use or in-situ during electrolysis. By said micropyretic methods materials have been obtained whose surfaces when oxidised are active for the anodic reaction and whose metallic interior has low electrical resistivity to carry a current from high electrical resistant surface to the busbars. However it would be useful, if it were possible, to simplify the manufacturing process of these materials obtained from powders and increase their life to make their use economic.

Metal or metal based anodes are highly desirable in aluminium electrowinning cells instead of carbon-based anodes. Many attempts were made to use metal-based anodes for aluminium production, however they were never adopted by the aluminium industry because of their poor performance.

OBJECTS OF THE INVENTION

An object of the invention is to substantially reduce the consumption of the active anode surface of an aluminium electrowinning anode which is attacked by the nascent oxygen by enhancing the reaction of nascent oxygen to biatomic molecular gaseous oxygen.

Another object of the invention is to provide a coating for an aluminium electrowinning anode which has a high electrochemical activity and also a long life and which can be replaced as soon as such activity decreases or when the coating is worn out.

A major object of the invention is to provide an aluminium electrowinning anode which has no carbon so as to eliminate carbon-generated pollution and reduce the cost of operation.

SUMMARY OF THE INVENTION

The invention provides a non-carbon metal-based anode of a cell for the electrowinning of aluminium, in particular by the electrolysis of alumina dissolved in a molten fluoride-containing electrolyte. The anode comprises an electrically conductive metal substrate resistant to high temperature, the surface of which becomes passive and substantially inert to the electrolyte, and an electrochemically active coating adherent to the surface of the metal substrate making and keeping the surface of the anode conductive and electrochemically active for the oxidation of oxygen ions present at the electrolyte interface.

Whereas conventional coatings are usually used to protect a conductive substrate of a cell component from chemical and/or mechanical attacks destroying the substrate, this particular treatment is applied in the form of a coating onto a passivatable substrate to maintain the anode surface conductive and electrochemically active and protect it from electrolyte attack wherever the coating covers the surface even though the coating may be imperfect or incomplete.

This allows the coated surfaces of the anode to remain electrochemically active during electrolysis, while the remaining parts of the surface of the metal substrate become inert to the electrolyte. This passivation property offers a self-healing effect, i.e. when the surface of the anode is imperfectly covered, damaged or partly worn out, parts of the metal substrate which come into contact with the electrolyte are automatically passivated during electrolysis and become inert to the electrolyte and not corroded.

Metal substrates providing for this self-healing effect in molten fluoride-based electrolyte may be made of one or more metals selected from nickel, cobalt, chromium, molybdenum, tantalum and the Lanthanide series of the Periodic Table, and their alloys or intermetallics, such as nickel-plated copper.

The coatings usually comprise:

a) at least one electrically conductive and electrochemically active constituent, b) an electrocatalyst, and c) a bonding material substantially resistant to cryolite and oxygen for bonding these constituents together and onto the passivatable metal substrate.

These constituents are usually co-applied though it is possible to provide sequential application of the different constituents.

The presence of one or more electrocatalysts is desirable, although not essential for the invention. Likewise the presence of bonding material is not always necessary.

Coatings can be obtained by applying their active constituents and their precursors by various methods which can be different for each constituent and can be repeated in several layers. For example, a coating can be obtained by directly applying a powder onto the passivatable metal substrate or constituents of the coating may be applied from a slurry or suspension containing colloidal or polymeric material. The colloidal material can be a binder solely or can be part of the active material. The colloidal material may include at least one colloid selected from colloidal alumina, ceria, lithia, magnesia, silica, thoria, yttria, zirconia, tin oxide, zinc oxide and colloid containing the active material.

When a slurry or a suspension containing colloidal material is applied the dry colloid content corresponds to up to 50 weight % of the colloid plus liquid carrier, usually from 10 to 20 weight %.

The coating can be applied on the substrate by plasma spraying, physical vapor deposition (PVD), chemical vapor deposition (CVD), electrodeposition or callendering rollers. A slurry or a dispersion is preferably applied by rollers, brush or spraying.

Usually the electrochemically active constituent(s) is/are selected from oxides, oxyfluorides, phosphides, carbides and combinations thereof.

The oxide may be present in the electrochemically active layer as such, or in a multi-compound mixed oxide and/or in a solid solution of oxides. The oxide may be in the form of a simple, double and/or multiple oxide, and/or in the form of a stoichiometric or non-stoichiometric oxide.

The oxides may be in the form of spinels and/or perovskites, in particular spinels which are doped, non-stoichiometric and/or partially substituted. Doped spinels may comprise dopants selected from $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3'}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

Such a spinel may be a ferrite, in particular a ferrite selected from cobalt, manganese, molybdenum, nickel and zinc, and mixtures thereof. The ferrite may be doped with at least one oxide selected from the group consisting of chromium, titanium, tantalum, tin, zinc and zirconium oxide.

Nickel-ferrite or nickel-ferrite based constituents are advantageously used for their resistance to electrolyte and may be present as such or partially substituted with $Fe^{2+}$.

The coating may also contain a chromite which is usually selected from iron, cobalt, copper, manganese, beryllium, calcium, strontium, barium, magnesium, nickel and zinc chromite.

The electrochemically active constituents of the coating may be selected from iron, chromium, copper and nickel, and oxides, mixtures and compounds thereof, as well as a Lanthanide as an oxide or an oxyfluoride such as cerium oxyfluoride, and mixtures thereof.

When an electrocatalyst is present in the coating it is selected preferably from noble metals such as iridium, palladium, platinum, rhodium, ruthenium, or silicon, tin and zinc, the Lanthanide series of the Periodic Table and mischmetal oxides, and mixtures and compounds thereof.

Coatings can be formed with or without reaction at low or high temperature. A reaction can either take place among the constituents of the coating; or between the constituents of the coating and the passivatable metal substrate. When no reaction takes place to form the coating the active constituents must already be present in the applied material, for example in a slurry or suspension applied onto the substrate.

In order to manufacture these anodes any electrically conductive and heat-resisting materials may be used. However, metals which do not offer the self-healing effect can only be used as metal cores which must be coated with a layer forming the passivatable metal substrate having this self-healing effect particularly when exposed to a fluoride-containing electrolyte, such as cryolite.

The metal core may comprise metals, alloys, intermetallics, cermets and conductive ceramics, such as metals selected from copper, chromium, cobalt, iron, aluminium, hafnium, molybdenum, nickel, niobium, silicon, tantalum, titanium, tungsten, vanadium, yttrium and zirconium, and combinations and compounds thereof.

For instance, the core may be made of an alloy comprising 10 to 30 weight % of chromium, 55 to 90 weight % of at least one of nickel, cobalt and/or iron and 0 to 15 weight % of at least one of aluminium, hafnium, molybdenum, niobium, silicon, tantalum, tungsten, vanadium, yttrium and zirconium.

The core may be covered with an oxygen barrier layer. This layer may be obtained by oxidising the surface of the core when it contains chromium and/or nickel or by applying a precursor of the oxygen barrier layer onto the core and heat treating. Usually, the oxygen barrier layer comprises chromium oxide and/or black non-stoichiometric nickel oxide.

The oxygen barrier layer may be covered in turn with at least one protective layer consisting of copper or copper and at least one of nickel and cobalt, and/or (an) oxide(s) thereof to protect the oxygen barrier layer by inhibiting its dissolution into the electrolyte. For instance, the oxygen barrier layer may be coated first with a nickel layer and then with a copper layer, heat treated for several hours in an inert atmosphere, such as 5 hours at 1000° C. in argon, to interdiffuse the nickel and the copper layer, and upon heat treatment in an oxidising media, such as an air oxidation for 24 hours at 1000° C., the interdiffused and oxidised nickel-copper layer constitutes a good a protective layer.

The invention relates also to a method of manufacturing the described non-carbon metal-based anode. The method comprises coating a substrate of electrically conductive metal resistant to high temperature the surface of which during electrolysis becomes passive and substantially inert to the electrolyte with at least one layer containing electrochemically active constituents or precursors thereof and heat-treating the or each layer on the substrate to obtain a coating adherent to the metal substrate making the surface of the anode electrochemically active for the oxidation of oxygen ions present at the electrolyte interface.

The method of the invention can be applied for reconditioning the non-carbon metal-based anode when at least part of the active coating has been dissolved or rendered non-active or dissolved. The method comprises clearing the surface of the substrate before re-coating said surface with a coating adherent to the passivatable metal substrate once again making the surface of the anode electrochemically active for the oxidation of oxygen ions.

Another aspect of the invention is a cell for the production of aluminium by the electrolysis of alumina dissolved in a fluoride-containing electrolyte, in particular a fluoride-based electrolyte or a cryolite-based electrolyte or cryolite, having non-carbon metal-based anodes comprising an electrically conductive passivatable metal substrate and a conductive coating having an electrochemically active surface as described hereabove.

Preferably, the cell comprises at least one aluminium-wettable cathode. Even more preferably, the cell is in a drained configuration by having at least one drained cathode on which aluminium is produced and from which aluminium continuously drains.

The cell may be of monopolar, multi-monopolar or bipolar configuration. A bipolar cell may comprise the anodes as described above as a terminal anode or as the anode part of a bipolar electrode.

Preferably, the cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB98/00161 (de Nora/Duruz) or by periodically moving the anodes as described in co-pending application PCT/IB98/00162 (Duruz/Bellò).

The cell may be operated with the electrolyte at conventional temperatures, such as 950 to 970° C., or at reduced temperatures as low as 750° C.

The invention also relates to the use of such an anode for the production of aluminium in a cell for the electrowinning of aluminium by the electrolysis of alumina dissolved in a fluoride-containing electrolyte, wherein oxygen ions in the electrolyte are oxidised and released as molecular oxygen by the electrochemically active anode coating.

The invention will now be described in the following examples.

EXAMPLE 1

An non-carbon metal-based anode is prepared according to the invention by hot calendar rolling at 900° C. of nickel ferrite particles having a particle size of 10–50 micron into a nickel metal sheet of 2 mm thickness used as an electrically conductive substrate for the anode. The nickel ferrite particles are coated onto the nickel sheet in an amount of 500 $g/m^2$.

After coating, the anode was tested in an electrolytic cell using cryolite with 6 weight % alumina as an electrolyte and a carbon cathode covered with molten aluminium. The anode was polarised at 1 $A/cm^2$ for 93 hours and sustained this current density during the entire test, the cell voltage remaining comprised between 5.5 and 5.8 Volts.

At the end of the test, the anode was dimensionally unchanged and no sign of corrosion could be detected at the anode surface.

EXAMPLE 2

A non-carbon metal-based anode according to the invention was obtained from a nickel substrate which was coated with a slurry with subsequent heat-treatment.

The slurry was made from a solution consisting of 10 ml of colloidal magnesia acting as a binder mixed with 20 g of nickel ferrite powder providing the electrochemically active constituents, as described in Example 1.

The slurry was then applied onto the substrate by means of a brush. 15 successive layers were applied onto the substrate. Each time a layer had been applied onto the substrate, the layer was cured on the substrate by a heat treatment at 500° C. for 15 minutes before applying the next layer.

After coating the substrate with the 15 successive layers the anode had a final coating of 0.6 to 1.0 mm thick.

The anode was then tested in a laboratory scale cell for the electrowinning of aluminium. 10 minutes after immersing the anode into the electrolytic bath the anode was extracted from the cell. The parts of the anodes which were not protected by the coating had been passivated under the effect of the current by the formation of an inert and adherent nickel oxide layer formed on the uncoated surfaces which could be observed by optical microscopy and scanning electron microscopy of a cross section of the anode after test.

EXAMPLE 3

Similarly to Example 2, a coating was applied onto a nickel substrate in 10 layers, except that 0.2 g of iridium powder acting as a catalyst were added to the mixture of colloidal alumina with nickel-nickel ferrite.

Similar results were observed.

What is claimed is:

1. A method of manufacturing a non-carbon metal-based anode of a cell for the electrowinning of aluminium, by the electrolysis of alumina dissolved in fluoride-containing electrolyte, said method comprising coating a substrate of electrically conductive metal resistant to high temperature and the surface of which becomes passive and substantially inert to the electrolyte with at least one layer of an electrochemically active coating precursor in the form of a slurry or suspension containing at least one electrochemically active constituent or a precursor thereof, and heat-treating the or each layer on the substrate to obtain a coating adherent to the passivatable metal substrate making the surface of the anode electrochemically active for the oxidation of oxygen ions present at the electrolyte interface.

2. The method of claim 1, wherein the passivatable metal substrate comprises at least one metal selected from nickel, cobalt, chromium, molybdenum, tantalum and the Lanthanide series, and their alloys or intermetallics.

3. The method of claim of claim 2, wherein the passivatable metal substrate is nickel-plated copper.

4. The method of claim 1, wherein the coating is formed by further applying at least one electrocatalyst or a precursor thereof for the formation of oxygen gas.

5. The method of claim 4, wherein the or at least one of said electrochemically active constituent(s) is selected from the group consisting of oxides, oxyfluorides, phosphides, carbides and combinations thereof.

6. The method of claim 5, wherein said oxides comprise spinels and/or perovskites.

7. The method of claim 6, wherein said spinels are doped, non-stoichiometric and/or partially substituted spinels, the doped spinels comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

8. The method of claim 6, wherein said spinels comprise a ferrite and/or a chromite.

9. The method of claim 8, wherein said ferrite is selected from the group consisting of cobalt, manganese, molybdenum, nickel and zinc, and mixtures thereof.

10. The method of claim 9, wherein the ferrite is doped with at least one oxide selected from the group consisting of chromium, titanium, tantalum, tin, zinc and zirconium oxide.

11. The method of claim 9, wherein said ferrite is nickel-ferrite or nickel-ferrite partially substituted with $Fe^{2+}$.

12. The method of claim 8, wherein said chromite is selected from the group consisting of iron, cobalt, copper, manganese, beryllium, calcium, strontium, barium, magnesium, nickel and zinc chromite.

13. The method of claim 5, wherein the or at least one of said electrochemically active constituent(s) comprises at least one Lanthanide as an oxide or a oxyfluoride, and mixtures thereof.

14. The method of claim 13, wherein said oxyfluoride is cerium oxyfluoride.

15. The method of claim 4, wherein the or at least one of said electrochemically active constituent(s) comprises at least one metal selected from iron, chromium, copper and nickel, and oxides, mixtures and compounds thereof.

16. The method of claim 1, wherein the coating is formed by further applying a bonding material substantially resistant to cryolite for bonding the constituents of the coating together and onto the passivatable metal substrate.

17. The method of claim 16, wherein said electrocatalyst(s) is/are selected from iridium, palladium, platinum, rhodium, ruthenium, silicon, tin and zinc, the Lanthanide series and mischmetal, and their oxides, mixtures and compounds thereof.

18. The method of claim 1, wherein the coating is obtained from a slurry or suspension containing colloidal or polymeric material.

19. The method of claim 1, wherein the slurry or suspension contains at least one of alumina, ceria, lithia, magnesia, silica, thoria, yttria, zirconia, tin oxide and zinc oxide, and colloids containing active constituents of the coating or precursors thereof, all in the form of colloids or polymers.

20. The method of claim 1, comprising reacting constituents of the coating precursor among themselves to form the coating.

21. The method of claim 1, comprising reacting at least one constituent of the coating precursor with the passivatable metal substrate to form the coating.

22. The method of claim 1, wherein the coating precursor is applied onto the substrate by rollers, brush or spraying.

23. The method of claim 1, comprising coating the passivatable metal substrate onto an electronically conductive core.

24. The method of claim 23, wherein the core is selected from metals, alloys, intermetallics, cermets and conductive ceramics.

25. The method of claim 23, wherein the metals of the core are selected from copper, chromium, cobalt, iron, aluminium, hafnium, molybdenum, nickel, niobium, silicon, tantalum, titanium, tungsten, vanadium, yttrium and zirconium, and combinations and compounds thereof.

26. The method of claim 25, wherein the core is an alloy comprising 10 to 30 weight % of chromium, 55 to 90 weight % of at least one of nickel, cobalt and/or iron and 0 to 15 weight % of at least one of aluminium, hafnium, molybdenum, niobium, silicon, tantalum, tungsten, vanadium, yttrium and zirconium.

27. The method of claim 25, comprising applying a precursor of the oxygen barrier layer onto the core and heat treating.

28. The method of claim 25, wherein the oxygen barrier layer comprises chromium oxide.

29. The method of claim 25, wherein the oxygen barrier layer comprises black non-stoichiometric nickel oxide.

30. The method of claim 25, comprising covering the oxygen barrier layer with at least one protective layer consisting of copper or copper and at least one of nickel and cobalt, and/or oxides thereof to protect the oxygen barrier layer by inhibiting its dissolution into the electrolyte.

31. The method of claim 23, comprising forming an oxygen barrier layer on the core.

32. The method of claim 31, comprising oxidising the surface of the core to form the oxygen barrier layer.

33. The method of claim 1 for reconditioning a non-carbon metal-based anode having a passivatable substrate with an electrochemically active coating, when at least part of the active coating has become non-active or worn out, said method comprising clearing the surface of the substrate before re-coating said surface with a coating applied from said slurry or suspension.

34. A non-carbon metal-based anode of a cell for the electrowinning of aluminium, by the electrolysis of alumina dissolved in fluoride-containing electrolyte, comprising an electrically conductive metal substrate resistant to high temperature, the surface of which becomes passive and substantially inert to the electrolyte, and an electrochemically active coating adherent to the surface of the metal substrate making and keeping the surface of the anode conductive and electrochemically active for the oxidation of oxygen ions present at the electrolyte interface, said coating containing electrochemically active constituents in a colloid obtainable from at least one electrochemically active constituent or a precursor thereof in a colloid-containing slurry or suspension.

35. The anode of claim 34, wherein the passivatable metal substrate comprises at least one metal selected from nickel, cobalt, chromium, molybdenum, tantalum and the Lanthanide series, and their alloys or intermetallics.

36. The anode of claim of claim 35, wherein the passivatable metal substrate is nickel-plated copper.

37. The anode of claim 34, wherein the coating further comprises at least one electrocatalyst or a precursor thereof for the formation of oxygen gas.

38. The anode of claim 34, wherein the coating further comprises a bonding material substantially resistant to cryolite for bonding the constituents of the coating together and onto the passivatable metal substrate.

39. The anode of claim 34, wherein the coating is a heat-treated slurry or suspension containing at least one heat-treated colloid or polymer selected from heat-treated colloidal or polymeric alumina, ceria, lithia, magnesia, silica, thoria, yttria, zirconia, tin oxide, and zinc oxide, and colloids containing active constituents of the coating or precursors thereof, all in the form of heat treated colloids or polymers.

40. The anode of claim 34, wherein the or at least one of said electrochemically active constituent(s) is selected from the group consisting of oxides, oxyfluorides, phosphides, carbides and combinations thereof.

41. The anode of claim 40, wherein said oxides comprise spinels and/or perovskites.

42. The anode of claim 41, wherein said spinels are doped, non-stoichiometric and/or partially substituted spinels, the doped spinels comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

43. The anode of claim 42, wherein said spinels comprise a ferrite and/or a chromite.

44. The anode of claim 43, wherein said ferrite is selected from the group consisting of cobalt, manganese, molybdenum, nickel and zinc, and mixtures thereof.

45. The anode of claim 44, wherein the ferrite is doped with at least one oxide selected from the group consisting of chromium, titanium, tantalum, tin, zinc and zirconium oxide.

46. The anode of claim 44, wherein said ferrite is nickel-ferrite or nickel-ferrite partially substituted with $Fe^{2+}$.

47. The anode of claim 43, wherein said chromite is selected from the group consisting of iron, cobalt, copper, manganese, beryllium, calcium, strontium, barium, magnesium, nickel and zinc chromite.

48. The anode of claim 40, wherein the or at least one of said electrochemically active constituent(s) comprises at least one Lanthanide as an oxide or an oxyfluoride, and mixtures thereof.

49. The anode of claim 48, wherein said oxyfluoride is cerium oxyfluoride.

50. The anode of claim 34, wherein the or at least one of said electrochemically active constituent(s) comprises at least one metal selected from iron, chromium, copper and nickel, and oxides, mixtures and compounds thereof.

51. The anode of claim 37, wherein said electrocatalyst(s) is/are selected from iridium, palladium, platinum, rhodium, ruthenium, silicon, tin and zinc, the Lanthanide series and mischmetal, and their oxides, mixtures and compounds thereof.

52. The anode of claim 34, wherein the passivatable metal substrate is coated on an electronically conductive core.

53. The anode of claim 52, wherein the core is selected from metals, alloys, intermetallics, cermets and conductive ceramics.

54. The anode of claim 53, wherein the metals of the core are selected from copper, chromium, cobalt, iron, aluminium, hafnium, molybdenum, nickel, niobium, silicon, tantalum, titanium, tungsten, vanadium, yttrium and zirconium, and combinations and compounds thereof.

55. The anode of claim 54, wherein the core is an alloy comprising 10 to 30 weight % of chromium, 55 to 90 weight % of at least one of nickel, cobalt and/or iron and 0 to 15 weight % of at least one of aluminium, hafnium, molybdenum, niobium, silicon, tantalum, tungsten, vanadium, yttrium and zirconium.

56. The anode of claim 52, wherein the core is covered with an oxygen barrier layer.

57. The anode of claim 56, wherein the oxygen barrier layer comprises chromium oxide.

58. The anode of claim 56, wherein the oxygen barrier layer comprises black non-stoichiometric nickel oxide.

59. The anode of claim 56, wherein the oxygen barrier layer is covered with at least one protective layer consisting of copper or copper and at least one of nickel and cobalt, and/or oxides thereof to protect the oxygen barrier layer by inhibiting its dissolution into the electrolyte.

60. A cell for the production of aluminium by the electrolysis of alumina dissolved in a fluoride-containing electrolyte having at least one non-carbon metal-based anode comprising an electrically conductive passivatable metal substrate and a conductive coating having an electrochemically active surface according to claim 34.

61. The cell of claim 60, wherein the electrolyte is cryolite.

62. The cell of claim 60, comprising at least one aluminium-wettable cathode.

63. The cell of claim 62, which is in a drained configuration, comprising at least one drained cathode on which aluminium is produced and from which aluminium continuously drains.

64. The cell of claim 62, which is in a bipolar configuration and wherein the anodes form the anodic side of at least one bipolar electrode and/or a terminal anode.

65. The cell of claim 62, comprising means to circulate the electrolyte between the anodes and facing cathodes and/or means to facilitate dissolution of alumina in the electrolyte.

66. A method of producing aluminium in a cell as defined in claim 60, comprising oxidising oxygen ions on the electrochemically active anode coating of the or each anode and aluminium on a cathode.

67. The method of claim 66, wherein during operation the electrolyte is at a temperature of 750° C. to 970° C.

* * * * *